US007818818B2

(12) United States Patent
Grilliot et al.

(10) Patent No.: US 7,818,818 B2
(45) Date of Patent: Oct. 26, 2010

(54) PROTECTIVE GARMENT, SUCH AS PROTECTIVE COAT, AND DRAG HARNESS

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 35 days.

(21) Appl. No.: 11/361,934

(22) Filed: Feb. 24, 2006

(65) Prior Publication Data

US 2007/0199135 A1 Aug. 30, 2007

(51) Int. Cl.
*A41D 1/02* (2006.01)
*A41D 3/02* (2006.01)
*A41F 19/00* (2006.01)

(52) U.S. Cl. ..... 2/94; 2/329

(58) Field of Classification Search ..... 2/458, 2/93, 94, 81, 69, 97, 310, 329, 331, 311; 182/3

See application file for complete search history.

(56) References Cited

U.S. PATENT DOCUMENTS 602,861 A * 4/1898 Lyon ..... 119/770
1,193,374 A * 8/1916 Gilliam ..... 482/69
1,749,999 A * 3/1930 Crocker ..... 482/69
2,212,746 A * 8/1940 Nunn ..... 119/770
2,382,816 A * 8/1945 Quilter et al. ..... 244/143
2,568,304 A * 9/1951 Schoenbrun ..... 119/770
2,979,153 A * 4/1961 Hoagland et al. ..... 182/3
3,074,074 A * 1/1963 Lovering ..... 2/94
3,973,643 A * 8/1976 Hutchinson ..... 182/3
3,997,921 A * 12/1976 Knight ..... 2/75
4,076,101 A * 2/1978 Himmelrich ..... 182/3
4,159,010 A * 6/1979 Mitro ..... 5/89.1
4,177,877 A * 12/1979 Gallinati ..... 182/3
4,273,216 A * 6/1981 Weissmann ..... 182/3
4,449,253 A * 5/1984 Hettinger ..... 2/93
4,560,097 A * 12/1985 Reynolds et al. ..... 224/160
4,599,750 A * 7/1986 Rahaman ..... 2/243.1
4,706,858 A * 11/1987 Whatley ..... 224/184
4,813,080 A * 3/1989 Toso ..... 2/94
4,854,418 A 8/1989 Hengstenberger et al.
4,922,860 A * 5/1990 Hutchings ..... 482/69
5,036,548 A * 8/1991 Grilliot et al. ..... 2/81
5,074,795 A * 12/1991 Clark ..... 434/253
5,080,191 A * 1/1992 Sanchez ..... 182/3
5,136,724 A * 8/1992 Grilliot et al. ..... 2/81
5,190,306 A * 3/1993 Nauman et al. ..... 280/202
5,289,590 A * 3/1994 Larson ..... 2/227
5,325,818 A * 7/1994 Leach ..... 119/770
5,356,355 A * 10/1994 Campbell ..... 482/43
5,369,804 A * 12/1994 Metcalf ..... 2/94
5,388,551 A * 2/1995 Martusciello ..... 119/770

(Continued)

*Primary Examiner*—Alissa L Hoey
(74) *Attorney, Agent, or Firm*—Wood, Phillips, Katz, Clark & Mortimer

(57) ABSTRACT

A drag harness is disposed within a protective garment, such as a protective coat, except that the drag harness has two gripping portions, each of which extends outwardly from the protective garment, through an associated one of two separate openings of the protective garment, and which are connected to each other, outside the protective garment. Being connected to each other outside the protective garment, the gripping portions cannot be inadvertently pulled in to the protective garment, through the garment openings.

9 Claims, 2 Drawing Sheets

U.S. PATENT DOCUMENTS 5,476,070 A * 12/1995 Gwon et al. ..... 119/770
5,542,123 A * 8/1996 DiPietro ..... 2/80
5,619,955 A * 4/1997 Nelson ..... 119/857
5,927,235 A * 7/1999 Olaiz ..... 119/770
5,970,517 A * 10/1999 Jordan ..... 2/69
6,006,968 A * 12/1999 McCarthy et al. ..... 224/184
6,073,280 A * 6/2000 Farnum ..... 5/89.1
6,101,631 A * 8/2000 Ferguson, Jr. ..... 2/94
6,105,169 A * 8/2000 Colorado ..... 2/81
6,125,792 A * 10/2000 Gee ..... 119/770
6,134,713 A * 10/2000 De Rosa et al. ..... 2/94
6,167,572 B1 * 1/2001 Naumovitz ..... 2/227
6,205,584 B1 3/2001 Yocco
6,244,379 B1 * 6/2001 Larson ..... 182/6
6,308,335 B1 * 10/2001 Colorado ..... 2/81
6,338,699 B1 * 1/2002 Veitch ..... 482/69
6,343,383 B1 * 2/2002 Madorma-Williams ..... 2/227
6,361,478 B1 * 3/2002 Giancaspro ..... 482/69
6,397,389 B1 * 6/2002 Schultz ..... 2/69
6,421,833 B2 * 7/2002 Khanamirian et al. ..... 2/69
6,427,252 B1 * 8/2002 Lewis et al. ..... 2/326
6,438,756 B1 * 8/2002 Colorado ..... 2/81
6,490,733 B1 * 12/2002 Casaubon ..... 2/81
6,499,149 B2 * 12/2002 Ashline ..... 2/468
6,658,666 B2 * 12/2003 Schweer ..... 2/94
6,662,372 B2 * 12/2003 Lewis et al. ..... 2/69
6,836,902 B2 * 1/2005 Marquez et al. ..... 2/69
6,968,809 B2 * 11/2005 Reardon ..... 119/770
7,036,628 B2 * 5/2006 Wilcox et al. ..... 182/9
7,131,703 B1 * 11/2006 Sheridan et al. ..... 297/465
7,134,969 B2 * 11/2006 Citron et al. ..... 473/277
7,225,472 B2 * 6/2007 McDonald et al. ..... 2/102
7,267,080 B2 * 9/2007 Gallo et al. ..... 119/770
2003/0196245 A1 * 10/2003 Schweer ..... 2/94
2003/0196246 A1 * 10/2003 Schweer ..... 2/94
2003/0207737 A1 * 11/2003 Sherman et al. ..... 482/69
2004/0045073 A1 * 3/2004 Marquez et al. ..... 2/69
2004/0112302 A1 * 6/2004 Guynn ..... 119/770
2004/0182644 A1 * 9/2004 Kotarski ..... 182/3
2004/0250332 A1 * 12/2004 Tadin ..... 2/94
2005/0150846 A1 7/2005 Grilliot et al.
2005/0173188 A1 8/2005 Lewis et al.
2005/0211188 A1 9/2005 Grilliot et al.
2005/0284696 A1 12/2005 Grilliot et al.
2006/0040805 A1 * 2/2006 Wilkinson ..... 482/124
2006/0070798 A1 * 4/2006 DiCristina et al. ..... 182/3
2006/0254533 A1 * 11/2006 Fuller et al. ..... 119/770
2006/0278176 A1 * 12/2006 Chigirnskaya et al. ..... 119/770
2007/0044197 A1 * 3/2007 Turcotte et al. ..... 2/69
2007/0084667 A1 * 4/2007 Waters et al. ..... 182/3
2008/0121191 A1 * 5/2008 Wu ..... 119/770
2008/0164095 A1 * 7/2008 Snedeker ..... 182/3
2008/0289089 A1 * 11/2008 Grilliot et al. ..... 2/458
2009/0200106 A1 * 8/2009 Mckay et al. ..... 182/3

* cited by examiner

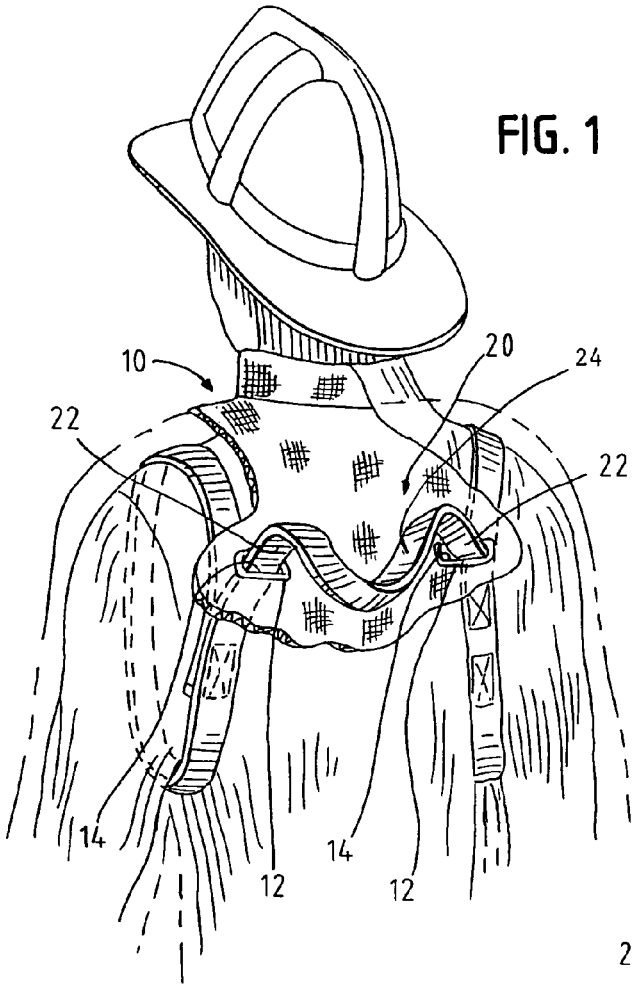
FIG. 1
FIG. 2
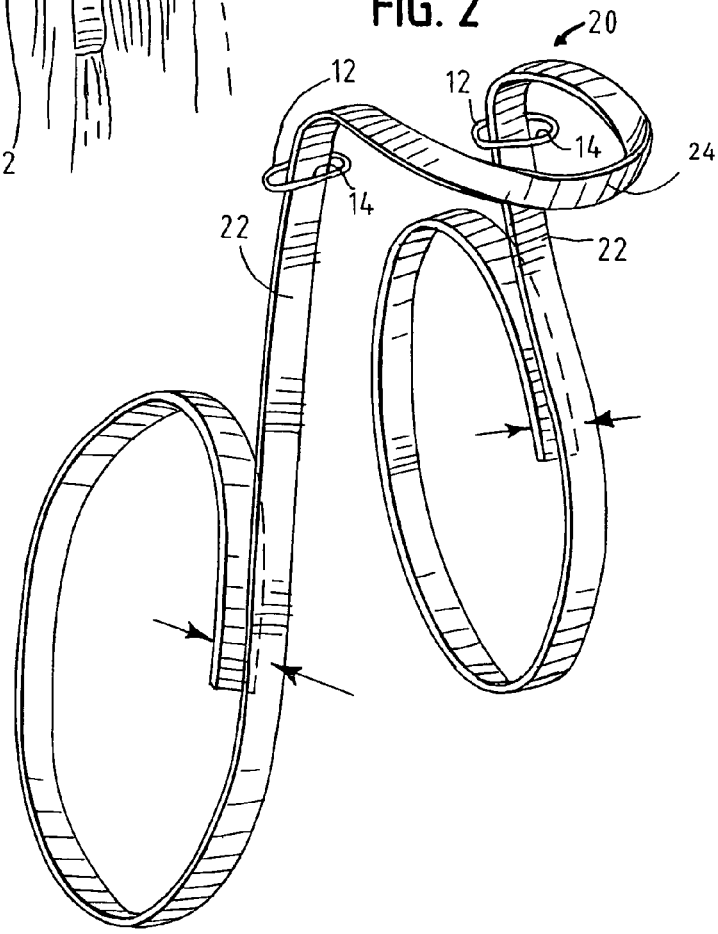

PROTECTIVE GARMENT, SUCH AS PROTECTIVE COAT, AND DRAG HARNESS

TECHNICAL FIELD OF THE INVENTION

This invention pertains to a protective garment, such as a protective coat, and a drag harness, in a novel combination.

BACKGROUND OF THE INVENTION

A drag harness, which may be also known as a drag rescue device (DRD) when used with a protective garment, such as a protective coat, for a firefighter or for an emergency worker, is used by a rescuer to drag an incapacitated person wearing the drag harness from a hazardous situation.

Such harnesses are exemplified in U.S. Pat. Nos. 4,854,418 and 6,205,584 B1 and, further, in United States Patent Application Publications No. US 2005/0150846 A1, US 2005/0173188 A1, US2005/0211188 A1, and US 2005/0284696 A1. The disclosures of these Patents and Application Publications are incorporated by reference herein.

As exemplified in U.S. Pat. No. 6,205,584 B1, it is known for a drag harness to be disposed within a protective coat except for a drag loop, which extends through an opening in the protective coat, outside the protective coat, so that a rescuer can grasp the drag loop for dragging an incapacitated person, via the drag harness.

Disadvantageously, it is possible for such a loop to be inadvertently pulled into the protective coat, through the opening in the protective coat, whereupon it may become a practical necessity for a rescuer to reinsert the drag loop through the opening in the protective coat before grasping the drag loop for dragging an incapacitated person, via the drag harness.

SUMMARY OF THE INVENTION

This invention provides a novel combination comprising a protective garment, such as a protective coat, and a drag harness, which is disposed within the protective garment, except that the drag harness has two gripping portions. Each of the gripping portions extends outwardly from the protective garment, through an associated one of two separate openings of the protective garment. Being connected to each other outside the protective garment, the gripping portions cannot be inadvertently pulled into the protective garment, through the garment openings.

Preferably, in the novel combination, the grip harness has means for connecting the gripping portions to each other, outside the protective garment. In one contemplated embodiment, the gripping portions and the connecting means define a loop. The gripping portions and the connecting means may be thus provided by a unitary length of strapping. In an alternative embodiment, each of the gripping portions is provided by a strapping length and the connecting means is provided by a strapping length, which is connected to and between the strapping lengths providing the gripping portions, outside the protective garment.

BRIEF DESCRIPTION OF THE DRAWINGS

FIG. 1 is a fragmentary, pictorial view of a firefighter wearing a protective coat, which is illustrated fragmentarily, and wearing a drag harness, which is worn within the coat, except the drag harness has two gripping portions which are connected to each other via a connecting means, outside the protective garment, in one contemplated embodiment wherein the gripping portions and the connecting means define a single loop and are provided by a single length of strapping.

FIG. 2 is a pictorial view of the drag harness of FIG. 1, apart from the protective coat, except that grommets defining two separate openings of the protective coat and having the gripping portions extending therethrough are illustrated.

DETAILED DESCRIPTION OF THE ILLUSTRATED EMBODIMENTS

Figure 3:
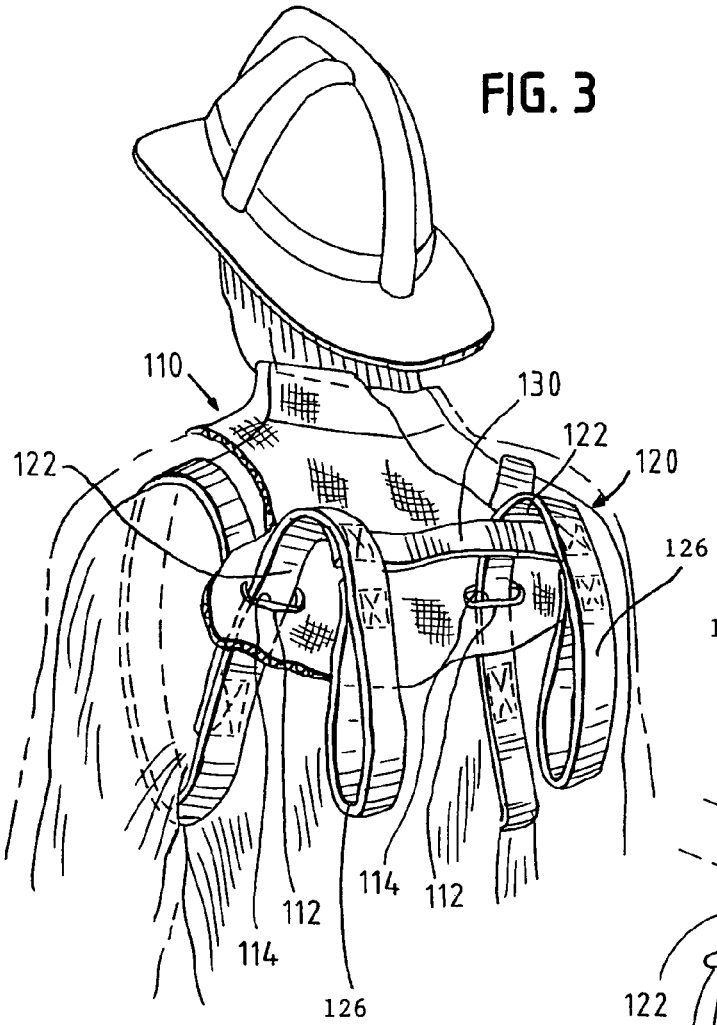
FIGS. 3 and 4 are analogous views of a firefighter wearing a protective coat and wearing a drag harness, in an alternative embodiment wherein each of the gripping portions defines a strapping loop and wherein the connecting means is provided by a separate length of strapping.

As illustrated in FIGS. 1 and 2, a novel combination constituting one contemplated embodiment of this invention comprises a protective coat 10 and a drag harness 20, which is disposed within the protective coat 10, except that each of two gripping portions 22 of the drag harness 20 extends outwardly from the protective coat 10, through a grommet 12 outlining an associated one of two separate openings 14 of the protective coat 10, and are connected to each other outside the protective coat 10.

As illustrated in FIGS. 1 and 2, a continuous, uninterrupted unitary length of strapping provides the gripping portions 22 and, further, provides means for connecting the gripping portions 22 to each other so as to define a single loop 24 exposed outside the protective coat 10. The single loop 24 thus has the same cross-sectional configuration over its entire exposed extent. Being connected to each other outside the protective coat 10 the gripping portions 22 cannot be inadvertently pulled into the protective coat 10, through the garment openings 14.

Figure 4:
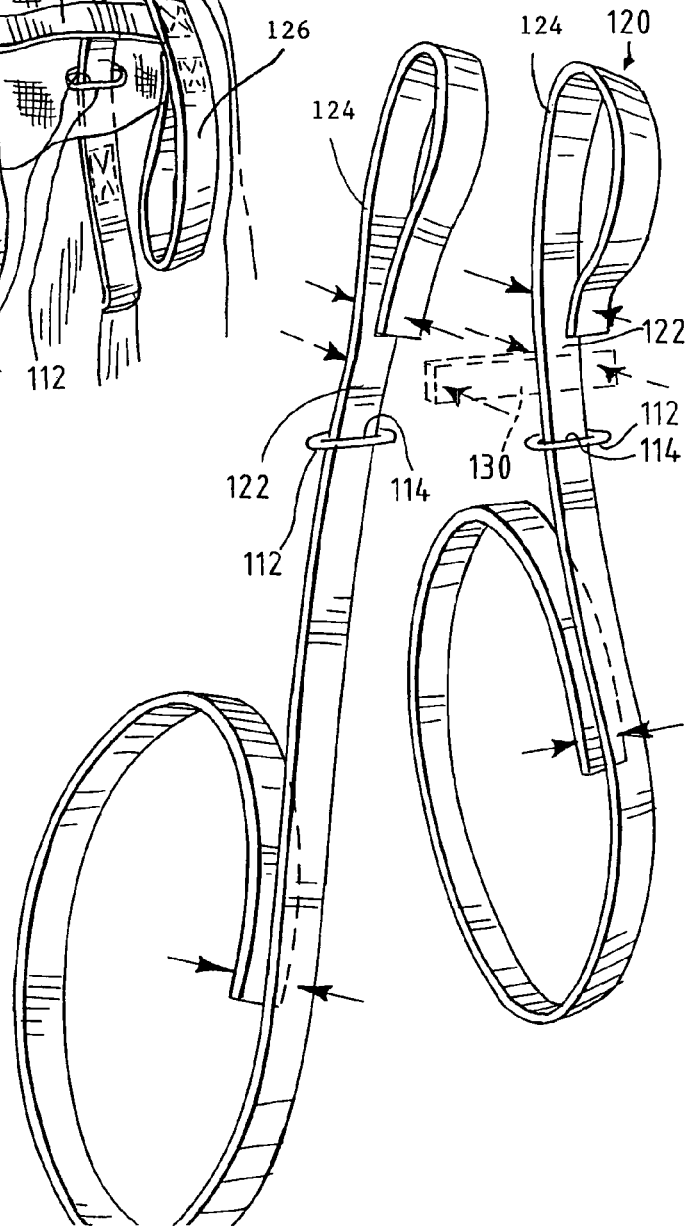

As illustrated in FIGS. 3 and 4, a novel combination constituting an alternative embodiment of this invention comprises a protective coat 110 and a drag harness 120, which is disposed within the protective coat 110, except that each of two gripping portions 122 of the drag harness 120 extends outwardly from the protective coat 110, through a grommet 112 outlining an associated one of two separate openings 114 of the protective coat 110, and are connected to each other outside the protective coat 10.

As illustrated in FIGS. 3 and 4, each of the gripping portions 122 is provided by a strapping length 124, which defines a separate loop 126 outside the protective coat 10. Moreover, a strapping length 130, which is separate from the strapping lengths 124 providing the gripping portions 122, is connected to and between the strapping lengths 124 providing the gripping portions 122, outside the protective coat 110 to unreleasably connect the gripping portions 122.

In each of the illustrated and described embodiments, further details of those portions of the drag harness that are disposed within the protective coat, are outside the scope of this invention. Moreover, this invention is applicable in a combination comprising a protective garment other than a protective coat, along with a drag harness.

The invention claimed is:

1. A combination comprising a protective garment and a drag harness entirely disposed within the protective garment when worn by a wearer except that the drag harness has two gripping portions, each of which extends outwardly from the protective garment through an associated one of two separate openings of the protective garment to define a loop so that there are two separate loops spaced from and unreleasably connected to each other outside the protective garment, each loop extending around an opening into which a user's hand can be directed to grasp each of the loops, the drag harness further including a pair of fixed length loops disposed within the protective garment to encircle a pair of limbs of a wearer, wherein each of the fixed length loops is defined by a continuous, uninterrupted strapping length that is permanently joined to itself to form the fixed length loop.

2. The combination of claim 1, wherein each of the gripping portions is provided by a strapping length and wherein the connecting means is provided by an additional strapping length, which is connected to and between the strapping lengths providing the gripping portions, outside and adjacent to the protective garment.

3. The combination of claim 1, wherein each of the gripping portions is provided by a strapping length and wherein the connecting means is provided by an additional strapping length, which is connected to and between the strapping lengths providing the gripping portions, outside the protective garment.

4. The combination according to claim 1, where the protective garment is a coat that has two limb covering portions extending from a torso covering portion and is suitable for use by a firefighter or other emergency worker.

5. The combination according to claim 1, where the protective garment is a protective coat.

6. A combination comprising a protective garment and a drag harness entirely disposed within the protective garment when worn by a wearer except that the drag harness has two gripping portions, each of which extends outwardly from the protective garment, through an associated one of two separate openings of the protective garment and except that the drag harness has means for unreleasably connecting the gripping portions to each other in a manner whereby the two gripping portions and connecting means form a loop defined by a continuous, uninterrupted, exposed strapping length, the loop having the same cross-section configuration over the entire, exposed strapping length, the drag harness further including a pair of fixed length loops disposed within the protective garment to encircle a pair of limbs of a wearer, wherein each loop of the pair of fixed length loops is defined by a continuous, uninterrupted length of strapping permanently joined to itself to form the fixed length loop.

7. The combination according to claim 6, where the protective garment is a coat that has two limb covering portions extending from a torso covering portion and is suitable for use by a firefighter or other emergency worker.

8. The combination according to claim 6, where the protective garment is a protective coat.

9. A combination comprising a protective garment and a drag harness entirely disposed within the protective garment except that the drag harness has two gripping portions, each of which extends outwardly from the protective garment through an associated one of two separate openings of the protective garment to define a loop so that there are two separate loops spaced from and unreleasably connected to each other outside the protective garment, each loop extending around an opening into which a user's hand can be directed to grasp each of the loops, the drag harness including a pair of loops dispersed within the protective garment to encircle a pair of limbs of a wearer, wherein each loop of said pair of loops is defined by a continuous, uninterrupted strapping length that is permanently joined to itself to form the loop.

* * * * *